US007159852B2

(12) United States Patent
Dow et al.

(10) Patent No.: US 7,159,852 B2
(45) Date of Patent: Jan. 9, 2007

(54) MANUAL MARINE WINCH INTERNAL GEARING

(75) Inventors: Justin E. Dow, Pittsburgh, PA (US); Erik R. Arlet, Mount Lebanon, PA (US); David B. Grapes, Pittsburgh, PA (US); Richard A. Topping, Jr., Pittsburgh, PA (US); Eric M. Konvolinka, Freedom, PA (US)

(73) Assignee: W W Patterson Company, Pittsburgh, PA (US)

( * ) Notice: Subject to any disclaimer, the term of this patent is extended or adjusted under 35 U.S.C. 154(b) by 131 days.

(21) Appl. No.: 11/003,023

(22) Filed: Dec. 2, 2004

(65) Prior Publication Data

US 2005/0133772 A1 Jun. 23, 2005

Related U.S. Application Data

(60) Provisional application No. 60/526,406, filed on Dec. 2, 2003.

(51) Int. Cl.
*B66D 1/14* (2006.01)

(52) U.S. Cl. ..... 254/342; 254/237; 254/332; 254/357

(58) Field of Classification Search ..... 254/329, 254/332, 341, 342, 356, 357
See application file for complete search history.

(56) References Cited

U.S. PATENT DOCUMENTS

| | | | | |
|---|---|---|---|---|
| 1,956,806 | A * | 5/1934 | Mitzen et al. | 254/342 |
| 2,684,833 | A * | 7/1954 | Benson | 254/357 |
| 2,891,824 | A * | 6/1959 | Fulton | 384/440 |
| 3,051,446 | A * | 8/1962 | Nelson et al. | 254/356 |
| 3,939,729 | A * | 2/1976 | Brockelsby | 74/575 |
| 3,946,990 | A * | 3/1976 | Tanner | 254/266 |
| 4,106,754 | A * | 8/1978 | Kucher | 254/352 |
| 4,456,227 | A * | 6/1984 | Notenboom | 254/350 |
| 5,603,489 | A * | 2/1997 | Regal | 254/378 |
| 5,947,450 | A * | 9/1999 | Grapes | 254/329 |
| 6,116,580 | A * | 9/2000 | Hull | 254/357 |
| 6,431,525 | B1 * | 8/2002 | Roll | 254/357 |
| 6,726,182 | B1 * | 4/2004 | Topping et al. | 254/376 |

* cited by examiner

*Primary Examiner*—Emmanuel M Marcelo
(74) *Attorney, Agent, or Firm*—Blynn L. Shideler; Krisanne Shideler; BLK Law Group

(57) ABSTRACT

A manual swivel winch of the present invention includes internal drum gearing. The winch has a pair of spaced side plates, a rotating drum supported between the side plates, an internal drum gear coaxially mounted with the rotating drum, and a pinion drive gear engaging and rotating the drum gear.

17 Claims, 3 Drawing Sheets

MANUAL MARINE WINCH INTERNAL GEARING

RELATED APPLICATIONS

This application claims the benefit of provisional application Ser. No. 60/526,406 entitled "Manual Marine Winch with Internal Gearing" filed Dec. 2, 2003 and incorporated herein by reference in its entirety.

BACKGROUND OF THE INVENTION

1. Field of the Invention

The present invention relates to manual marine winches. More specifically, the present invention relates to a manual marine swivel winches having internal gearing for barge coupling.

2. Background Information

Winches have been used in many applications. Manual swivel and stationary winches have been widely used in barges, tow boats and the like. The use of barges, sometimes called lighters, to transport cargo is common in marine transportation. Barges may be used singly, or in groups generally referred to as "barge trains" or "tows". These tows can be up to 40 barges in size (five wide and eight deep). The barges in a barge train carrying goods in harbors and along rivers are, usually, lashed tightly together through winches (located on each end of or in the four corners of each barge) and associated cable lines, two or three abreast, with several successive rows of such barges in one barge train. Typically a manual swivel winch is pivotally attached to a D-ring on a barge boat deck and spools a towing cable on a rotating drum, whereas a stationary winch is welded or otherwise secured to the deck.

These marine winches must be quick and easy to use and often are exposed to an abrasive environment and can become immersed in coal, ore or other material being transported. Consequently, these winches also must have a sturdy construction. Examples of manual winches are sold by W. W. Patterson Company and Nashville Bridge Company. The most common type of manual winch includes a pivoting pawl, or dog, engaging a ratchet gear of a ratchet for the winch. The pawl prevents the unwinding of the reel during engagement of the pawl. W.W. Paterson manufactures a sturdy manual marine winch having an open bottom configuration that saves material and provides easy winch clean-up as described in U.S. Pat. No. 5,947,450 which is incorporated herein by reference in its entirety.

Additionally, in conventional marine winch constructions, the tension or slack take up at the beginning of the tensioning operation requires a number of rotations of the drum and the wrapping of the winch line around the drum. This labor-intensive slack take up increases the time for the tensioning of the winch and must also be accounted for when paying out the load and when decoupling the winch line from the winch. The wire rope simply does not wrap easily around a small diameter drum found on conventional marine winches. Multiple layers of wire rope on the drum will also reduce the achievable tension of the drum and add the possibility of the payoff line becoming wedged in the lower wraps. A problem associated with marine winches is deck space. Deck space is a premium on barges and all marine craft. Consequently, minimizing the size of the drum and associated components of a marine winch is very advantageous since the overall footprint and height of the resulting winch can be reduced., W.W. Patterson has proposed a sturdy small manual marine winch that addresses these concerns in pending U.S. patent application Ser. No. 09/965,788 which has been published as U.S. Published Patent Application No. 20030057409 and which is also incorporated herein by reference.

The marine winches of the existing designs, of which the above patent and patent applications are representative, have exposed drum gearing that presents an ever present danger to the operators. The drum gearing is often provided with external protective shrouding, but this is not always completely effective and adds additional cost to the overall device. Operator clothing can still occasionally become caught and damaged in the gearing.

It is an object of the present invention to overcome the aforementioned drawbacks of the prior art. It is a further object of the present invention to provide a manual marine swivel winch which provides gearing shrouding integral with the gearing and that is simple and efficient in operation.

SUMMARY OF THE INVENTION

The above stated objects achieved with a swivel manual marine winch according to the present invention. A manual swivel winch of the present invention includes internal drum gearing. Internal gearing within the meaning of this specification are gears having radially inwardly facing gear teeth, whereby the tips of the gear teeth are radially inward of the base of the gear teeth. The winch has a pair of spaced side plates, a rotating drum supported between the side plates, an internal drum gear coaxially mounted with the rotating drum, and a pinion drive gear engaging and rotating the drum gear.

DESCRIPTION OF THE PREFERRED EMBODIMENTS

FIGS. 1–5 illustrate a manual swivel winch 10 according to the present invention. The general details and operation of the winch 10 can be found in U.S. Pat. No. 5,947,450 which is incorporated herein by reference. The present design incorporates the open bottom structure of U.S. Pat. No. 5,947,450. Additionally the present design incorporates the lead-in webbing strap marine winch construction of pending U.S. patent application Ser. No. 09/965,788, which has been published as U.S. Published Patent Application No. 20030057409 and which is also incorporated herein by reference.

The winch 10 includes a pair of spaced side plates 12 defining an open bottom, and a mechanism 14 for attaching the winch 10 to a boat deck. The term boat deck is intended to generally refer to the deck of any marine vessel; however, the winch 10 will most commonly be utilized on barges. The attachment mechanism 14 in the winch 10 includes a plate between the side plates of the housing 12 for pivotally attaching the winch 10 to a D-ring or the like of a boat deck.

The pivotal attachment allows the winch 10 to be a swivel winch meaning that the relative position of the winch 10 can rotate up to 360 degrees about the connection to the boat deck. The attachment mechanism for the winch 10 may also be a weldment to fixedly attach the housing 12 to the boat deck for a non-pivoting winch. The side plates 12 are preferably formed with a generally arcuate top surface with an arch in the lower surface forming access openings in the housing to allow easy debris removal.

Figure 5:
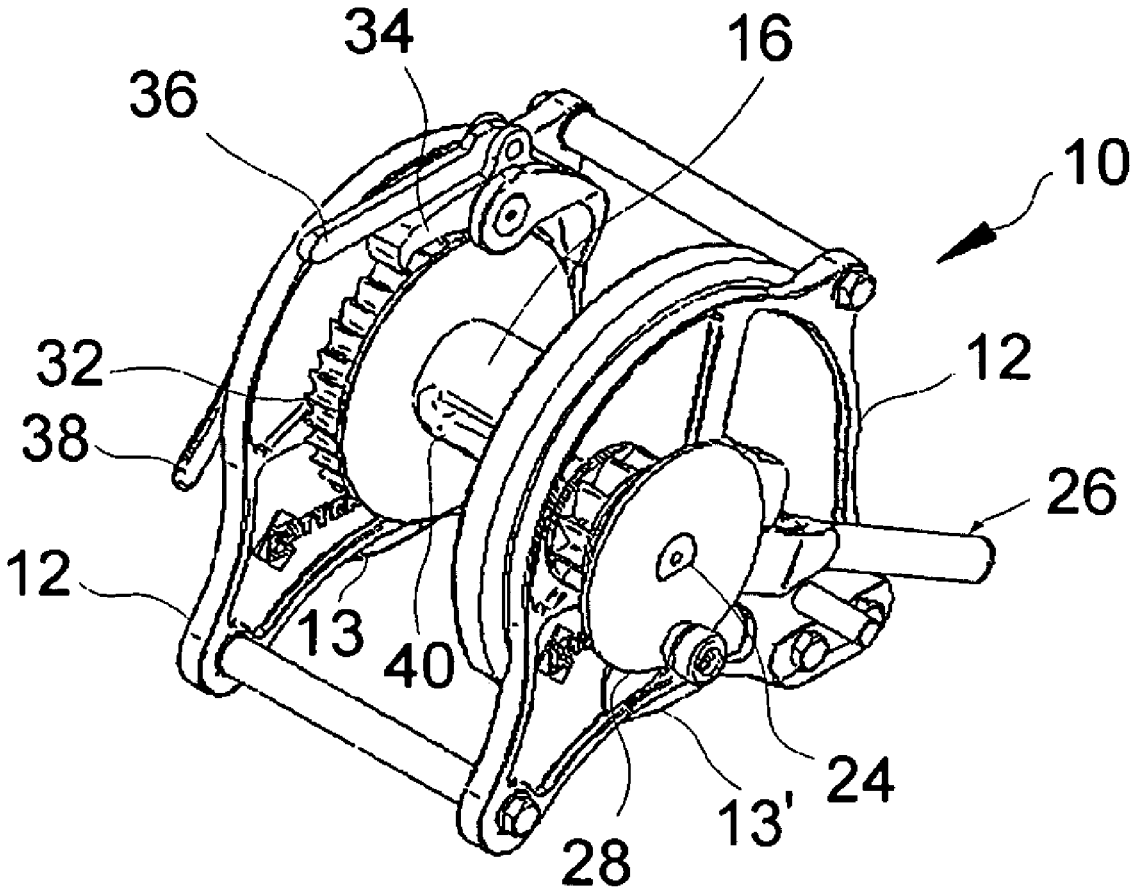
FIG. 5 is a perspective rear view of a modified winch similar to FIG. 2.

A rotating drum 16 is supported between the side plates 12 forming part of a spool assembly. The spool assembly also includes an internal drum gear 20 coupled to the drum 16. The internal drum gear 20 is formed with internally facing gear teeth, and is also called a ring type gear such as found in planetary gearing systems. The internal drum gear 20 has no external gearing and is effectively self-shrouded. Further, the open side of the internal gear 20 can be protected by positioning the gear 20 closely adjacent to the side plate 12, whereby operators could not have fingers or clothing slip into the gearing 20. The arcuate top surface of the side plates 12 generally matches the curve of the gear 20 providing a compact housing structure. A lower portion of the side plate 12, shown as 13, is reduced in thickness to allow a greater space for material that finds its way into the internal gearing to fall out of the winch 10. A further modification for the side plate 12 is to omit some or all of the reduced portion 13 to allow the material to be flushed out of the gearing 20, as shown in FIG. 5 with the omitted portion labeled 13'. The winch 10 of FIG. 5 is of an opposite hand than the winch 10 of FIGS. 1–4 and it shows the inclusion of a spacing bar between the upper ends of the side plates 12, however these minor variations do not alter the operation of the winch 10. A further modification would be to slant to root of the gearing 20 such that the base of each tooth is slanted outwardly to help any material fall or slide out of the gearing 20 through the assistance of gravity, and would result in an appropriate beveling of the drive pinion 22 to match the sloped bottom of the gear teeth.

Figure 1:
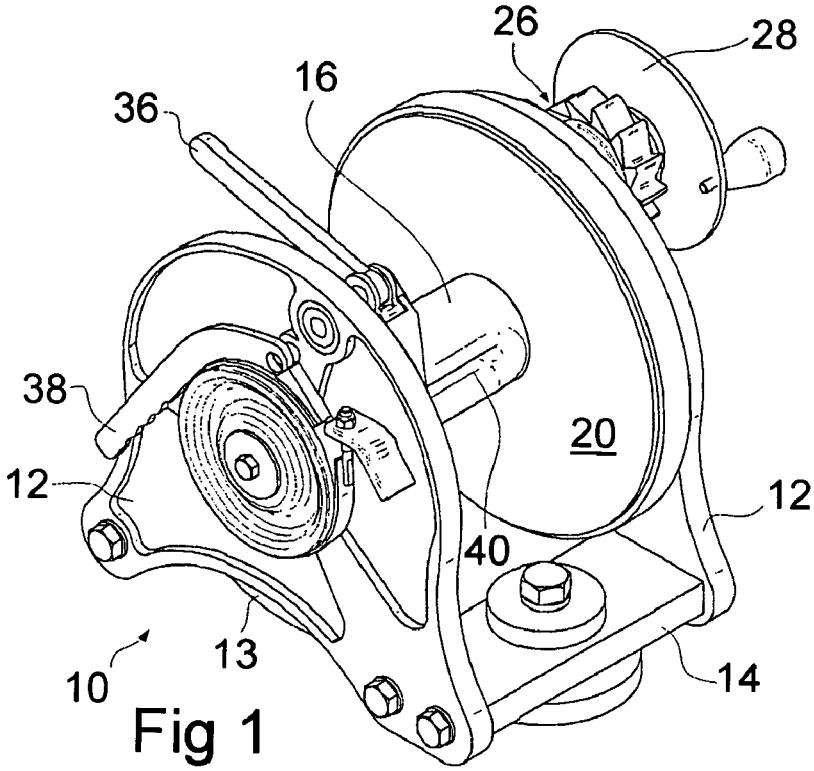
FIG. 1 is a perspective front view of a manual swivel marine winch having internal gearing according to a first embodiment of the present invention.
Figure 2:
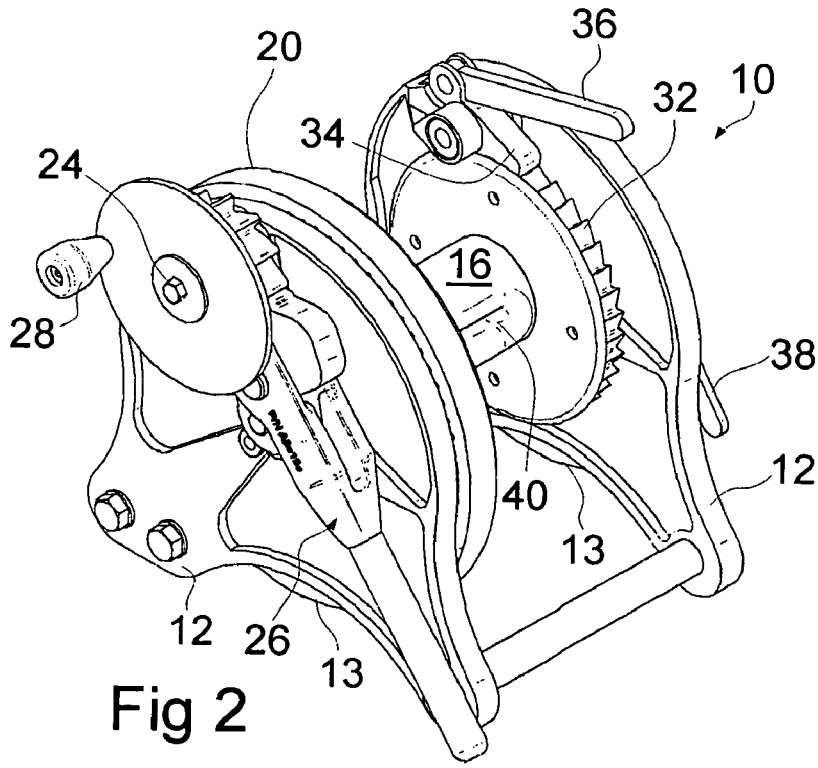
FIG. 2 is a perspective rear view of the winch of FIG. 1.
Figure 3:
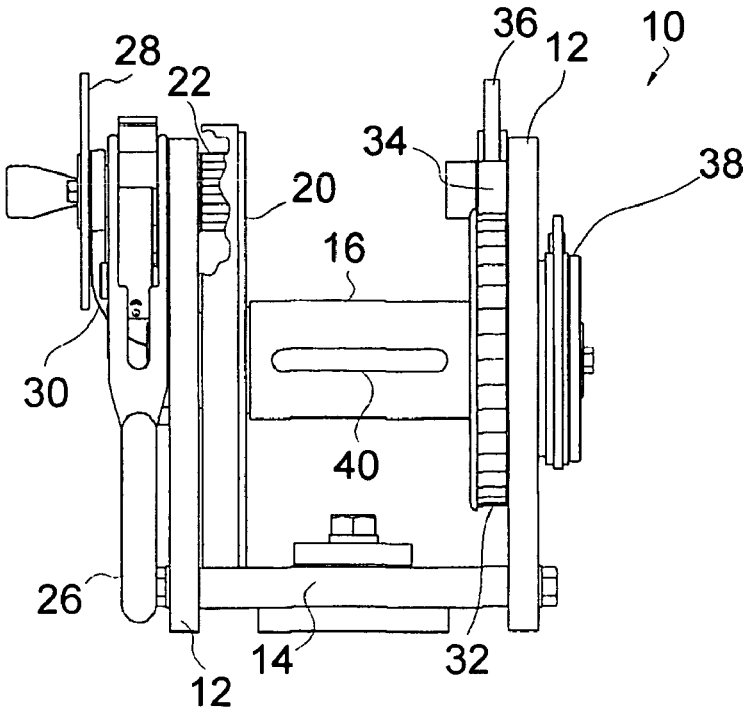
FIG. 3 is a front view of the winch of FIG. 1, with a portion of the internal drum gearing removed to illustrate the drive pinion.
Figure 4:
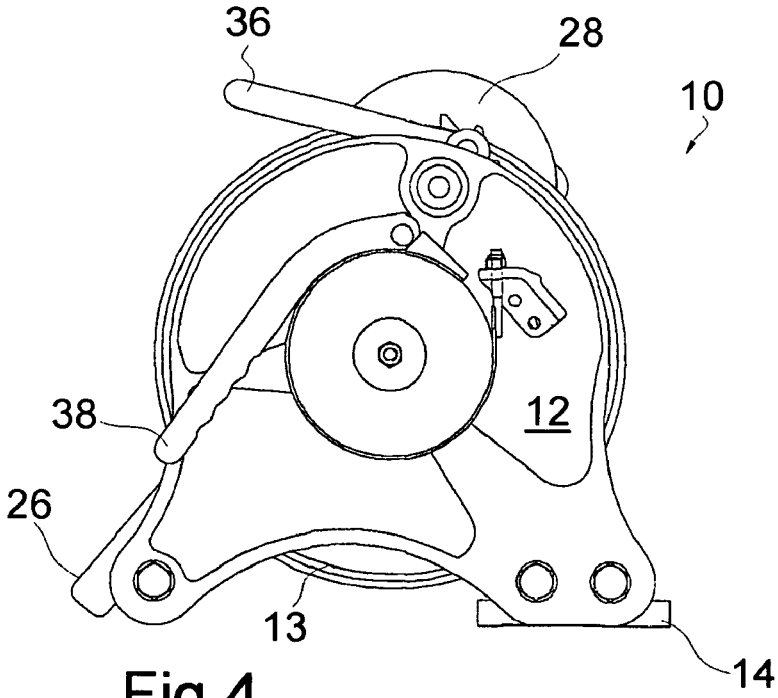
FIG. 4 is a side view of the winch of FIG. 1.

An internal cantilevered drive pinion 22, shown in FIG. 3 which has removed a portion of the internal gear 20, is mounted on shaft 24 and meshes with the internal drive gear 20. The drive pinion 22 and is manually rotated through either a conventional ratcheting lever assembly 26 mounted outside the side plate 12, or a hand wheel 28. The hand wheel 28 and a spur gear of the lever assembly 26 are mounted on shaft 24. The operation of the hand wheel 28 and lever assembly 26 are conventional and are well known in the art. The shaft 24 includes an outer support 30 coupled to the side plate 12 as shown in FIG. 3. The outer support will help maintain the cantilevered pinion gear 22 in position, particularly when the lever assembly 26 is used by the operators to rotate the winch 10 about the connection point.

Additionally, the spool assembly includes a load holding gear 32 adjacent the drum 16. One locking dog 34 engages the load holding gear 32 for holding tension on the winch 10. When the load holding device is separated from the tensioning device (i.e. the drum gear 20) the tensioning device can be made smaller. The required holding tension is greater than the loading tension due mainly to shock loading that will not occur during the tensioning operation. Further, the load holding gear 32 and locking dog or pawl 34 does not pose the same danger to operators since there is no meshing gear (e.g. drive pinion 22). The locking dog 34 includes a pivoted knock out handle 36. The knock out handle 36 is moved to one position to move the center of gravity on one side of the locking dog mounting shaft to bias the locking dog 34 into engagement with the gear 34. The knock out handle 36 is moved to a second position to move the center of gravity of the locking dog assembly onto the other side of the locking dog mounting shaft to bias the locking dog 34 out of engagement with the gear 34 (and the operator may strike the knock out handle to accomplish this disengagement where there is still tension holding the locking dog 34 in place). A conventional hand brake 38 having a replaceable band around a drum is also utilized.

The hand wheel 28, hand brake 38, locking dog 34, ratcheting lever assembly 26, cantilevered drive pinion 22 and internal drive gear 20 combine to form a mechanism operating in essentially a conventional fashion for rotating and holding tension on the drum 16 as will be well known in the art. The unique construction of the cantilevered drive pinion 22 and drum gear 20 of the gearing drive system is what is unique in this application, together with the associated housing. The conventional operation will not be described further. A detailed explanation of this operation is provided in U.S. Pat. No. 5,947,450, incorporated herein by reference as discussed above. Additionally, this operation can be found in marine winches sold by W. W. Patterson Company and others in the industry.

The winch 10 according to the present invention has a winch line having a lead in end formed of a webbing strap as described in pending U.S. patent application Ser. No. 09/965,788 which has been published as U.S. Published Patent Application No. 20030057409 and which is also incorporated herein by reference. The webbing strap extends through a slot 40 in the drum 16 and provides for rapid slack take up, a smaller drum diameter and other advantages as further described in the '788 application.

An advantage of the winch 10 of the present invention is that it largely utilizes existing winch technology for many components, although the winch 10 shown is illustrated with specialized components such as side plates 12 with portion 13 and the knock out handle 36 construction for the locking dogs 34. The main modification of an existing winch to the winch 10 of the present invention is replacing the existing drive gearing with internal gear 20 and pinion 22 of the present design. Consequently, a wide variety of existing manual winches may be easily retrofitted by replacing the drum gearing and drive pinion (and the support therefore) according to the present invention.

The invention has been described with reference to the preferred embodiment, but it is not intended to be limited thereby. Obvious modifications and alterations will occur to others upon reading and understanding the proceeding detailed description. For example, the gear 32 may be made internal with locking dog 34 cantilevered on the inside thereof with the knock out handle 36 mounted on the outside of the side plate 12 on the same locking dog mounting shaft. A similar modification would be to eliminate the gear 32 and have the locking dog 34 engage the drive gear 20 directly at a position spaced from the pinion 22. It is intended that the invention be construed as including all such modifications and alterations insofar as they come within the scope of the appended claims or the equivalents thereof.

What is claimed is:

1. A manual swivel winch comprising:

a pair of spaced side plates;

a rotating drum supported between the side plates;

an internal drum gear coaxially mounted with the rotating drum;

a pinion drive gear positioned within the internal drum gear, wherein the pinion drive gear engages and rotates the internal drum gear;

a mechanism for rotating the pinion drive gear; and a load holding gear mounted adjacent the drum.

2. The manual swivel winch of claim 1 wherein the pinion rotating mechanism includes a lever supported by at least one side plate for rotating the pinion drive gear.

3. The manual swivel winch of claim 2 further including a hand wheel for rotating the pinion gear.

4. The manual swivel winch of claim 1 wherein the pinion is cantilevered from the side plate.

5. The manual swivel winch of claim 4 further including a spur gear coaxially mounted with the pinion and rotated by the lever.

6. The manual swivel winch of claim 5 further including a hand brake.

7. The manual swivel winch of claim 6 wherein the drum includes a central slot for receiving a webbing strap there through.

8. The manual swivel winch of claim 1 further including a locking dog engaging the load holding gear.

9. The manual swivel winch of claim 8 wherein the locking dog includes a knock out handle pivoted thereto.

10. The manual marine winch of claim 1 wherein the side plates have an arcuate top surface substantially matching the curvature of the internal gear.

11. A manual swivel winch comprising:

a pair of spaced side plates;

a rotating drum supported between the side plates;

an internal drum gear coaxially mounted with the rotating drum;

a pinion drive gear positioned within the internal drum gear, wherein the pinion drive gear engages and rotates the internal drum gear;

a mechanism for rotating the pinion drive gear, wherein the pinion rotating mechanism includes a lever supported by at least one side plate for rotating the pinion drive gear;

a hand wheel for rotating the pinion gear; and a spur gear coaxially mounted with the pinion and rotated by the lever.

12. The manual swivel winch of claim 11 further including a load holding gear mounted adjacent the drum.

13. A manual swivel winch comprising:

a pair of spaced side plates, wherein the side plates have an arcuate top surface and an arched lower surface;

a rotating drum supported between the side plates;

a drum gear coaxially mounted with the rotating drum, with one side plate positioned adjacent the drum gear, wherein the curvature of the drum gear substantially matches the curvature of the top surface of the side plates;

a pinion drive gear engaging and rotating the drum gear;

a mechanism for rotating the pinion drive gear, wherein the pinion rotating mechanism includes a lever supported by at least one side plate for rotating the pinion drive gear, and further including a hand wheel for rotating the pinion gear; and wherein the pinion rotating mechanism includes a lever supported by at least one side plate for rotating the pinion drive gear, and further including a hand wheel for rotating the pinion gear, a spur gear coaxially mounted with the pinion and rotated by the lever, and wherein the pinion is cantilevered from the side plate and the drum gear is an internal gear.

14. The manual swivel winch of claim 13 further including a hand brake and wherein the drum gear is an internal gear.

15. The manual swivel winch of claim 13 wherein the drum includes a central slot for receiving a webbing strap there through.

16. The manual swivel winch of claim 13 further including a load holding gear mounted adjacent the drum and further including a locking dog engaging the load holding gear and wherein the drum gear is an internal gear.

17. The manual swivel winch of claim 16 wherein the locking dog includes a knock out handle pivoted thereto.

* * * * *